US006280348B1

(12) United States Patent
Stites

(10) Patent No.: US 6,280,348 B1
(45) **Date of Patent: *Aug. 28, 2001**

(54) IRON-TYPE GOLF CLUB HEAD

(75) Inventor: John T. Stites, Fort Worth, TX (US)

(73) Assignee: Nike USA, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/476,573

(22) Filed: Jan. 3, 2000

Related U.S. Application Data

(63) Continuation-in-part of application No. 08/989,817, filed on Dec. 12, 1997, now Pat. No. 6,077,173.

(51) Int. Cl.[7] ..... A63B 53/04

(52) U.S. Cl. ..... 473/334; 473/349; 473/350

(58) Field of Search ..... 473/324, 345, 473/346, 349, 350, 290, 291, 409; D21/747, 748, 749

(56) References Cited

U.S. PATENT DOCUMENTS

| | | | |
|---|---|---|---|
| D. 313,829 | | 1/1991 | Antonious . |
| D. 329,266 | | 9/1992 | Antonious . |
| D. 332,478 | | 1/1993 | Antonious . |
| D. 359,539 | | 6/1995 | Allen . |
| D. 360,445 | | 7/1995 | Schmidt et al. . |
| D. 360,925 | | 8/1995 | Antonious . |
| D. 362,041 | | 9/1995 | Takahashi et al. . |
| D. 362,481 | | 9/1995 | Takahashi et al. . |
| D. 362,883 | | 10/1995 | Krzynowek et al. . |
| D. 363,332 | | 10/1995 | Krzynowek et al. . |
| D. 364,206 | | 11/1995 | Schmidt et al. . |
| D. 364,434 | | 11/1995 | McGraw et al. . |
| D. 365,616 | | 12/1995 | Lee . |
| D. 371,182 | | 6/1996 | Stites . |
| D. 373,164 | | 8/1996 | Wang . |
| D. 377,068 | | 12/1996 | Stites, III . |
| D. 377,380 | | 1/1997 | Antonious . |
| D. 377,381 | | 1/1997 | Takahashi et al. . |
| 3,814,437 | | 6/1974 | Winquist . |
| 4,213,613 | | 7/1980 | Nygren . |
| 4,420,156 | * | 12/1983 | Campau . |
| 4,607,846 | | 8/1986 | Perkins . |
| 4,826,172 | | 5/1989 | Antonious . |
| 4,915,386 | | 4/1990 | Antonious . |
| 5,014,993 | | 5/1991 | Antonious . |
| 5,048,835 | | 9/1991 | Gorman . |
| 5,082,278 | | 1/1992 | Hsien . |
| 5,312,106 | | 5/1994 | Cook . |
| 5,335,914 | | 8/1994 | Long . |
| 5,377,985 | | 1/1995 | Ohnishi . |
| 5,395,113 | | 3/1995 | Antonious . |
| 5,447,307 | | 9/1995 | Antonious . |
| 5,547,194 | * | 8/1996 | Aizawa . |
| 5,549,297 | | 8/1996 | Mahaffey . |
| 5,643,112 | | 7/1997 | Besnard et al. . |
| 6,077,173 | * | 6/2000 | Stites . |

* cited by examiner

*Primary Examiner*—Sebastiano Passaniti
(74) *Attorney, Agent, or Firm*—Akin, Gump, Strauss, Hauer & Feld, LLP

(57) ABSTRACT

The present invention provides an iron-type golf club head having a bridge member across a cavity on its rear surface, which member influences the trajectory of a golf ball struck by the club head. By altering the bridge member orientation across the cavity on the rear surface, the club head can be made to propel a ball in various directions. Thus, the trajectory of golf balls struck by the club head can be high, low, rightward, leftward, or combinations thereof.

23 Claims, 9 Drawing Sheets

IRON-TYPE GOLF CLUB HEAD

CROSS-REFERENCE TO EARLIER FILED APPLICATIONS

This application is a continuation-in-part of U.S. Ser. No. 08/989,817 filed Dec. 12, 1997, which is now U.S. Pat. No. 6,077,173.

FIELD OF THE INVENTION

The present invention relates generally to an iron-type golf club head and more particularly to an iron-type golf club head having a single bridge member which employs point loads for weight distribution on its rear surface for influencing the trajectory of a ball struck by the golf club head.

BACKGROUND OF THE INVENTION

While many of the known club head designs are merely ornamental, some club head designs are claimed to provide a player with some degree of control over the trajectory of a ball struck by the club head or to provide a more "balanced" club head. These game improvement clubs generally encompass a variety of materials and mass/weight distribution patterns. The main purpose for the design of most of these balanced club heads is to improve consistency and performance.

The art is replete with examples of iron-type golf club heads that include features such as club heads having a single cavity on the back, club heads having a single stepped cavity on the back, club heads having a single cavity and one or more weights on the back, club heads having a single cavity on the back surrounded by a sectionalized peripheral belt, club heads having two or more cavities on the back, and club heads having one or more weights disposed within a closed cavity.

The present inventor's earlier U.S. Design Patent D371,182 discloses a dual-cavity iron-type golf club head having on its back surface an upper larger cavity separated from a lower smaller cavity. Further, the dual cavity club head does not operate similar to the club heads of the present invention since it does not employ point loads for weight distribution.

Antonius (U.S. Pat. No. 4,826,172) discloses an iron-type golf club head having two equally-sized bridge members spaced away from the back of the club head and attached to the peripheral belt surrounding the back of the club head. The two bridge members of equal mass must be disposed on opposite sides of and be equally spaced from the center of percussion. This type of construction provides a club head having a striking face with a softer feel; however, this club head fails to impart any significant effect upon or control of the trajectory of a ball struck by the club head, i.e., Antonius fails to disclose a club head having a single bridge member spaced away from the back of the club head, wherein the position, shape and/or mass of the bridge member influences the trajectory of a ball struck by the club head.

Known iron-type golf club heads generally address the issue of controlling golf ball trajectory by altering club head mass distribution; however, none of the known art discloses an iron-type golf club head according to the present invention which comprise a single bridge member attached to a peripheral belt surrounding a cavity on the back of the club head, wherein the bridge-member superposes the cavity and influences the trajectory of a golf ball struck by the club head.

SUMMARY OF THE INVENTION

The present invention comprises an iron-type golf club head having a single bridge member along its back surface for influencing the trajectory of a ball struck by the golf club head. By strategically attaching the ends of the bridge member to a peripheral belt surrounding a single cavity in the back of the club head, the club head will propel a golf ball in a predetermined direction when the ball is struck by the center of percussion of the golf ball-striking surface of the golf club head.

According to a preferred embodiment of the present invention, the iron-type golf club head having a solid metal body of a defined weight comprises:

- a face defined by a substantially flat first plane and including a golf ball-striking surface with a center portion;
- a heel having an upwardly extending hosel for receiving one end of an elongated shaft;
- a toe opposite and taller in height than the heel, the face being interposed the toe and the heel;
- a sole interposed the heel and the toe and disposed below the face;
- a top-line interposed the heel and the toe and superposed the sole and the face;
- a back defined by a second plane which is inclined relative to the first plane defining the face, the back being opposite the face and having a single open cavity, the cavity extending toward the face and covering a majority of the back, the cavity having a first larger portion adjacent the toe and a second smaller portion adjacent the heel;
- a peripheral belt surrounding the cavity of the back and including a toe perimeter portion, a heel perimeter portion, a sole perimeter portion, a top-line perimeter portion and junction perimeter portions interposed adjacent ones of the toe, heel, sole and top-line perimeter portions, wherein a majority of the weight of the club head is disposed within the peripheral belt; and
- a single bridge member spaced from the back, superposed a portion of the cavity and disposed along the second plane defining the back, the bridge member comprising a first end attached to one of the top-line, heel, toe, sole and junction perimeter portions and a second end attached to one of the top-line, heel, toe, sole and junction perimeter portions;
- wherein the trajectory of a ball struck by the center of the golf-ball-striking surface of the face is influenced by the location of the bridge member.

According to preferred embodiments of the present invention, the bridge member comprises a first lower density metal and a second higher density metal. In other preferred embodiments, the bridge member comprises at least 5–20%, more particularly at least 15%, of the total weight of the club head.

In still other embodiments, the first and second ends of the bridge member are attached to the peripheral belt as follows:

a) the first and second ends of the bridge member are attached to the top-line perimeter portion;

b) the first and second ends of the bridge member are attached to the sole perimeter portion;

c) the first end of the bridge member is attached to the top-line perimeter portion and the second end of the bridge member is attached to any one of the toe, sole, heel and junction perimeter portions;

d) the first end of the bridge member is attached to the sole perimeter portion and the second end of the bridge member is attached to any one of the toe, heel and junction perimeter portions;

e) the first end of the bridge member is attached to the heel perimeter portion and the second end of the bridge member is attached to any one of the toe and junction perimeter portions;

f) the first end of the bridge member is attached to the toe perimeter portion and the second end of the bridge member is attached to any one of the junction perimeter portions; and g) the first end of the bridge member is attached to one of the junction perimeter portions and the second end of the bridge member is attached to a different one of the junction perimeter portions.

According to another preferred embodiment, the invention provides an iron-type golf club head having a solid metal body comprising:

a face defined by a substantially flat first plane and including a golf-ball-striking surface with a center portion, the face having an opposing rear surface;

a back defined by a second plane which is inclined relative to the first plane defining the face, the back being opposite the face and having a single open cavity extending toward the face and covering a majority of the back, the cavity having a first larger portion adjacent the toe and a second smaller portion adjacent the heel;

a peripheral belt surrounding the cavity of the back and including a toe perimeter portion, a heel perimeter portion, a sole perimeter portion, a top-line perimeter portion and junction perimeter portions interposed adjacent ones of the toe, heel, sole and top-line perimeter portions, wherein a majority of the weight of the club head is disposed within the peripheral belt; and a single bridge member superposed a portion of the cavity, spaced away from the rear surface of the face, and disposed along the second plane defining the back, the bridge member comprising a first end attached to one of the top-line, heel, toe, sole and junction perimeter portions and a second end attached to one of the top-line, heel, toe, sole and junction perimeter portions;

wherein the trajectory of a ball struck by the center of the golf ball-striking surface of the face is influenced by the shape, orientation, weight, thickness, width, disposition, or center of mass of the bridge member.

According to yet another preferred embodiment, the invention provides an iron-type golf club head comprising:

a peripheral belt surrounding a cavity defined by a rear surface in the back of the club head; and a single bridge member superposing and spaced away from the rear surface, the bridge member having two ends, each attached to the peripheral belt;

wherein the shape, orientation, weight, thickness, width, disposition, or center of mass of the single bridge member effects the disposition of the moment of inertia of the club head and influences the trajectory of a ball struck by the club head.

The present invention provides a simple and versatile system for influencing the trajectory of a golf ball struck by an iron-type golf club head. According to a preferred embodiment of the system of the present invention, the system comprises:

an iron-type, solid body golf club head comprising a substantially planar face having a golf ball-striking surface with a center portion, a back opposite the face having a single large cavity extending toward the face, a peripheral belt having respective perimeter portions connecting the face and the back and surrounding the cavity; and a single bridge member spaced from the back and superposed a portion of the cavity, the bridge member comprising first and second ends each attached to a perimeter portion of the peripheral belt;

wherein the trajectory of a ball struck by the golf ball striking surface of the golf club head is influenced by the bridge member.

The present invention also provides a method of preparing an iron-type golf club head having a bridge member for influencing the trajectory of a golf ball struck by the club head. Thus, in one preferred embodiment, the present invention is a method of preparing a bridge-back, iron-type golf club head comprising the steps of:

providing an iron-type, solid body golf club head comprising a substantially planar face having a golf ball-striking surface with a center portion, a back opposite the face having a single large cavity extending toward the face, a peripheral belt having respective perimeter portions connecting the face and the back and surrounding the cavity;

providing a bridge member having first and second ends; and attaching each of the first and second ends to a perimeter portion of the peripheral belt such that the bridge member superposes a portion of the cavity.

Each aspect and embodiment of the invention provides unique and advantageous features which overcome most, if not all, of the disadvantages of and which are substantially different than known devices and methods.

Other features, advantages and embodiments of the invention will be apparent to those skilled in the art by the following description, accompanying examples and appended claims.

BRIEF DESCRIPTION OF THE DRAWINGS

The following drawings form part of the present specification and are included to further demonstrate certain aspects of the invention. The invention may be better understood by reference to one or more of these drawings in combination with the detailed description of the specific embodiments presented herein. In each of the FIGS, the circled "X" indicates a point of attachment of the bridge member to the peripheral belt and a corresponding point load as described below.

DETAILED DESCRIPTION OF THE INVENTION

The bridge-back, iron-type golf club head of the present invention comprises a single bridge member advantageously adapted to influence the trajectory of a golf ball struck by the face of the club head. The simple design and construction of the club head is particularly advantageous in that it does not require extensive modification of the club head in order to manufacture the various embodiments contemplated.

In contrast to the club head disclosed by Antonius (U.S. Pat. No. 4,826,172), the present invention provides a club head having a single bridge member, rather than two equally-sized bridge members, that is spaced away from the back of the club head. The use of just one as opposed to two bridge members is preferred since the resulting club head provides a greater influence upon and control of the trajectory of a ball struck by the club head. Moreover, the various changes permitted in the shape, weight and disposition of the single bridge member permit one to balance the relative influence that the moment of inertia, heel-toe effect, and top-line-sole effect have on the trajectory of a ball struck by the club head.

Figure 1:
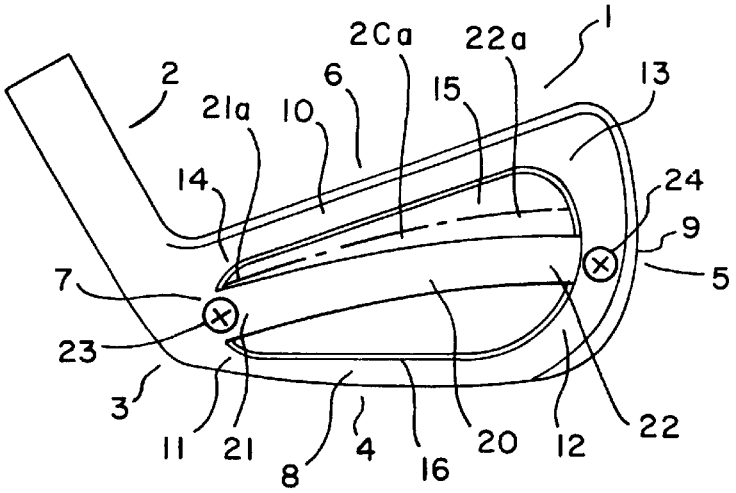
FIG. 1 is a rear elevation of a first embodiment of an iron-type golf club head according to the present invention.

Referring now to FIG. 1, the iron-type golf club head (1) of the present invention has a solid metal body which comprises: a face (not shown); a heel (3) having an upwardly extending hosel (2) for receiving one end of an elongated shaft (not shown); a toe (5) opposite and taller in height than the heel (3), the face being interposed the toe (5) and the heel (3); a sole (4) interposed the heel (3) and the toe (5) and disposed below the face; a top-line (6) interposed the heel (3) and the toe (5) and superposed the sole (4) and the face; a back (shown but not numbered) having a single large open cavity (15) extending toward the face, the cavity (15) having a first larger portion adjacent the toe (5) and a second smaller portion adjacent the heel (3); a peripheral belt (shown but not numbered) having top-line (10), heel (7), sole (8), toe (9), and junction perimeter portions (11, 12, 13, 14) completely surrounding the cavity (15), the majority of the weight of the club head residing in the peripheral belt; and a bridge member (20) having a first end (21) attached to heel (7) and a second end (22) attached to toe (9).

Without being held to a particular mechanism, the iron-type golf club head (1) of the present invention is believed to operate by one or more of the following mechanisms: 1) changing the moment of inertia of the club head; 2) changing the mass/weight distribution of the club head; 3) displacing the center of mass/gravity of the club head; and/or 4) point-loading the net effective mass of the club toward different regions of the peripheral belt and club head.

The points of attachment (23) and (24), indicated by the encircled "x"s, between the bridge member (20) and the peripheral belt correspond approximately with the point loads of the club head.

For purposes of this application, the term "point load" is defined to mean a point of attachment between the bridge member (20) and the peripheral belt at which a portion of the weight of the bridge member (20) lies and is focused onto. Since the bridge member (20) of the present invention comprises two ends, the club head always has two point loads. By moving the point loads along the peripheral belt, the center of mass/gravity of the club head is displaced, i.e. altering the weight distribution, of the golf club head influences or has an effect upon the trajectory of a ball struck by the golf club. Thus, by moving the point loads along the peripheral belt, the bridge member (20) can cause the club head to propel a ball along a predetermined trajectory, assuming the ball is struck by the ball-striking surface of the club.

For purposes of this application, the term "influencing the trajectory of a ball struck by the striking surface of the golf club head" means that the bridge member (20) can provide a user of the club head with some control over the direction and trajectory of a ball struck by the striking face of the golf club head.

The position of the single bridge member can influence the trajectory of a ball struck by the center of the striking face. The bridge member is preferably located about the center of percussion and attached to the peripheral belt as needed to provide the desired effect upon the trajectory of a ball struck by the club head. Although within the scope of the present invention, the mass of the single bridge member need not be disposed evenly about the center of percussion. In a preferred embodiment, the mass of the bridge member is disposed unevenly about the center of percussion. For example, when both points of attachment of the bridge member are located below the level of the center of percussion at the sole, the club head will have a greater lift such that a ball struck by the club head will have a trajectory with a higher loft than if the bridge member were absent. The reverse is also true.

For example as depicted in FIG. 1, the bridge member (20) is attached to opposing perimeter sections (7) and (9) of the peripheral belt. That is, the first end (22) of the bridge member (20) is attached to the toe perimeter section (9) and the second end (21) of the bridge member is attached to the heel perimeter section (7). This particular golf club head has balanced left-right and high-low influences upon the trajectory of a ball struck by the golf club head. Accordingly, a golf ball struck by the center of the golf ball striking surface of the club head will generally have a balanced trajectory.

Figure 18:
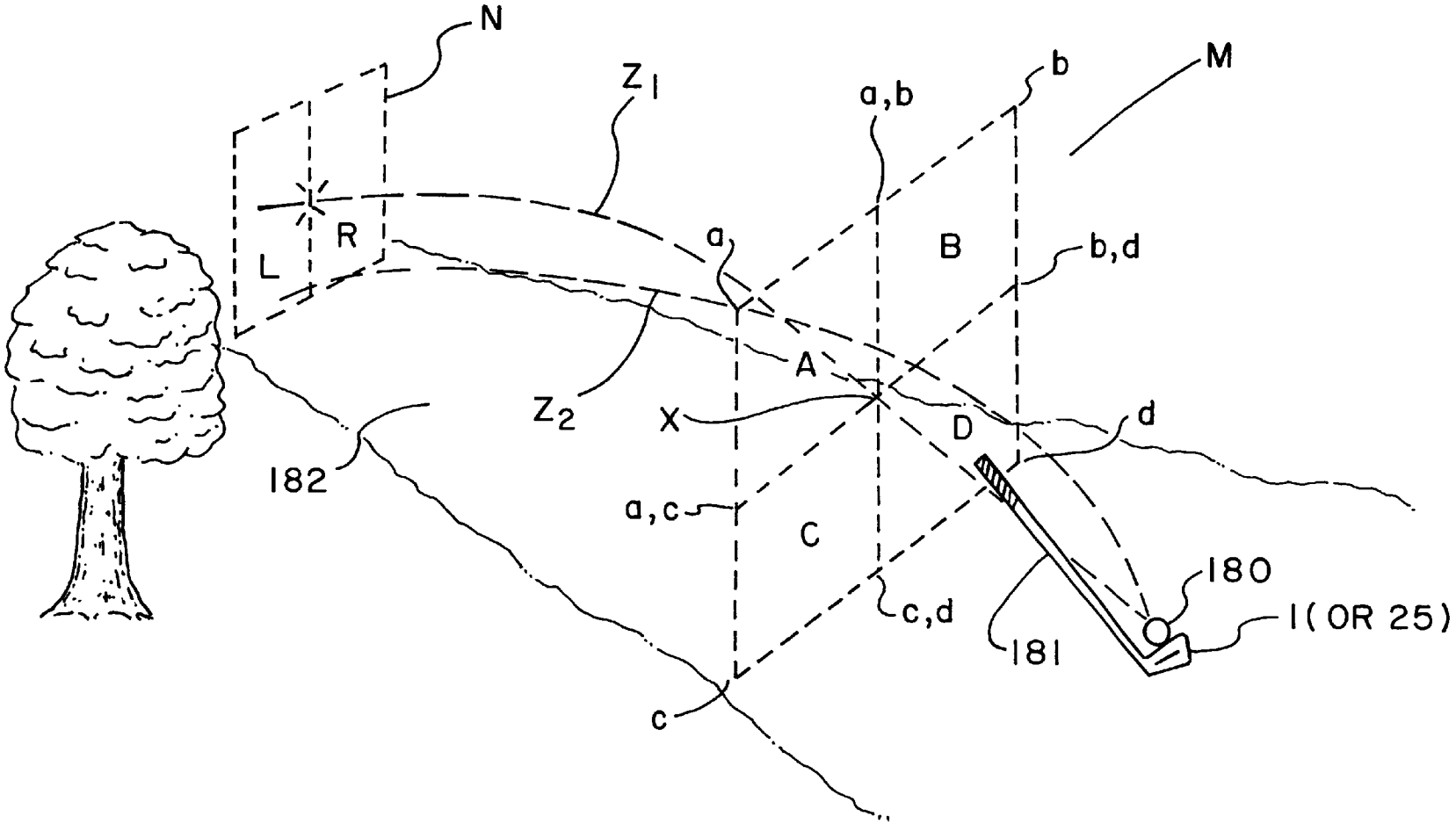
FIG. 18 is a perspective elevation of the iron-type golf club head shown in FIG. 1 in use.

For further clarification of the inventive features of the iron-type club heads of the present invention, refer to FIG. 18 which depicts golf club (181) comprising club head (1) in use. Golf ball (180) preferably is propelled along trajectory ($Z_1$) which generally passes through centrally located intersection (X) of imaginary frame (M), i.e. the club head has balanced high-low influence, and the trajectory ($Z_1$) preferably does not pass through either of the imaginary quadrants (A), (B), (C), or (D) of imaginary frame (M). As golf ball (180) moves down the fairway (182), it will tend to stay in the center of the fairway and will generally not travel to either the left side (L) or right side (R) of imaginary frame (N), i.e. the club head has balanced leftright influence.

Figure 2:
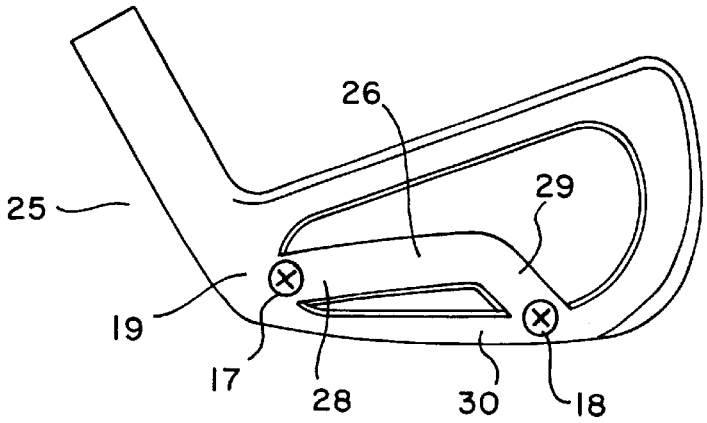
FIG. 2 is a rear elevation of a second embodiment of an iron-type golf club head according to the present invention.

It is contemplated by the present invention that the bridge member (20) can be attached to any of the perimeter sections of the peripheral belt on the back of the golf club head. Depicted in FIG. 2 is a second preferred embodiment of the iron-type golf club head of the present invention, wherein the first end (28) of the bridge member (26) is attached to the heel (19) of golf club head (25) and the second end (29) of the bridge member (26) is attached to the sole perimeter section (30) of the peripheral belt. A golf ball struck by the golf ball striking surface of club head (25), will have an initially high trajectory due to the location of point load (18) and will also tend to move towards the left of the fairway due to the location of point load (17).

For further clarification of the inventive features of club head (25), refer to FIG. 18. When golf ball (180) is struck by club head (25), it will preferably travel along trajectory ($Z_2$) which passes through upper left quadrant (A) of imaginary frame (M). In this embodiment, golf ball (180) will tend to move toward the left (L) of imaginary frame (N) as it travels down the fairway (182). Thus, club head (25) has a high trajectory influence due to the point load (18) and a left trajectory influence due to the point load (17). While club head (25) is exemplary of one embodiment of the invention, there are several other embodiments contemplated by the present invention.

Figure 3:
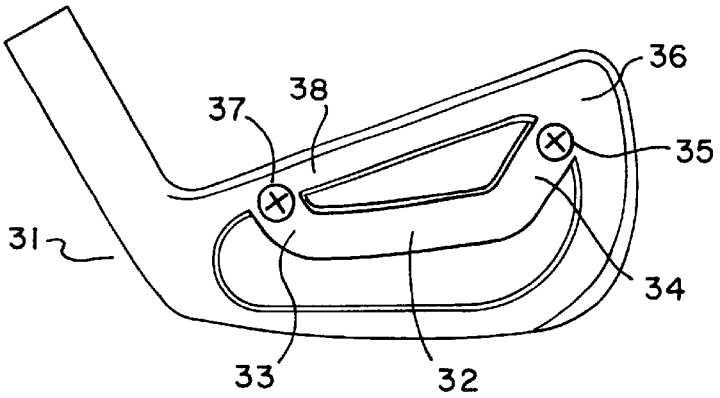
FIG. 3 is a rear elevation of a third embodiment of an iron-type golf club head according to the present invention.

Referring now to FIG. 3, club head (31) comprises a bridge member (32) which has a first end (33) attached to top-line perimeter section (38) and a second end (34) attached to the junction perimeter section (36). The points of attachment (37 and 35) indicated by the encircled X's correspond to the point loads created by bridge member (32). A golf ball struck by the golf ball striking surface of club head (31) will tend to have a low trajectory due to the attachment of the first end (33) to the top-line perimeter section (38) and the second end (34) to junction perimeter section (36). Club head (31) will also tend to drive a ball toward the right of the fairway.

Figure 4:
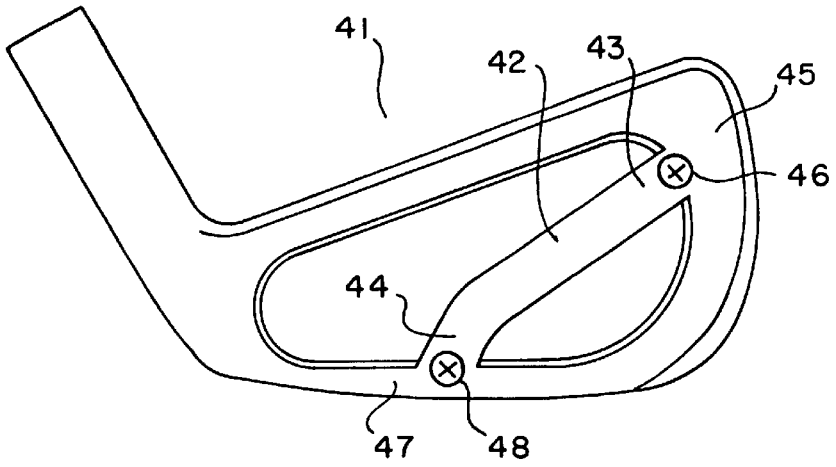
FIG. 4 is a rear elevation of a fourth embodiment of an iron-type golf club head according to the present invention.

FIG. 4 depicts club head (41) which comprises a bridge member (42) which has a first end (44) attached to sole perimeter section (47) and a second end (43) attached to junction perimeter section (45). A golf ball struck by this golf club head will tend to have a high initial trajectory due to the attachment of the first end (44) to the sole perimeter section (47). The golf ball will also tend to move toward the right of the fairway due to the attachment of the second end (43) to the junction perimeter section (45).

Figure 5:
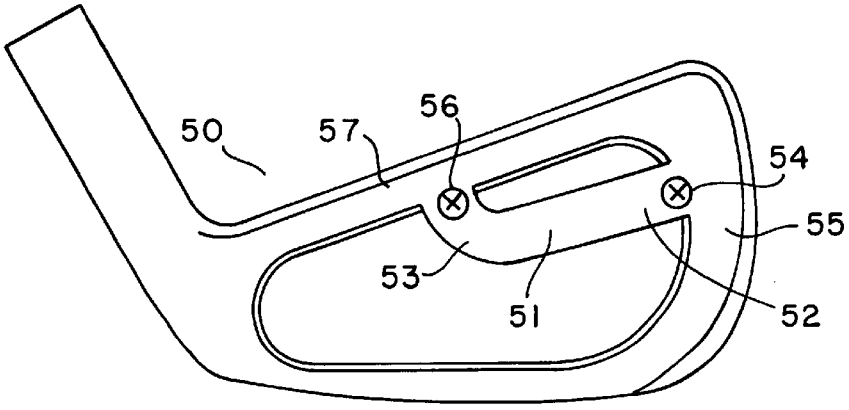
FIG. 5 is a rear elevation of a fifth embodiment of an iron-type golf club head according to the present invention.

FIG. 5 depicts club head (50) comprising bridge member (51) which has a first end (53) attached to the top-line perimeter section (57) and a second end (52) attached to the toe perimeter section (55). This golf club head will tend to drive a ball in a low trajectory towards the right of the fairway.

Figure 6:
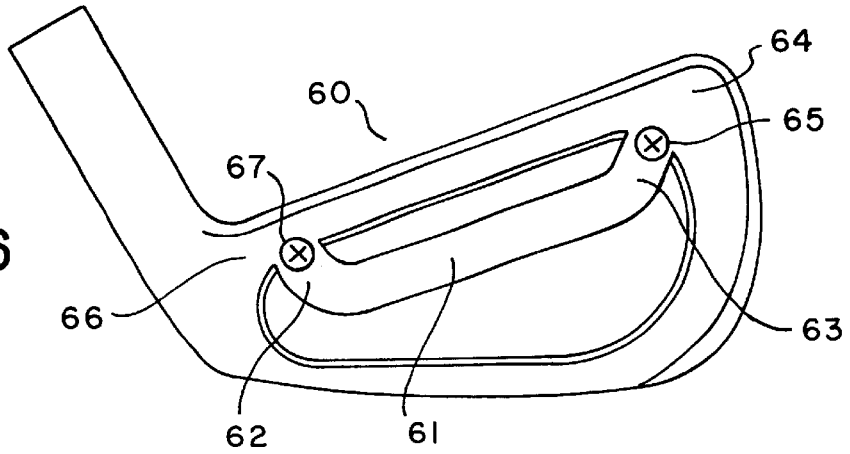
FIG. 6 is a rear elevation of a sixth embodiment of an iron-type golf club head according to the present invention.

The golf club head (60) depicted in FIG. 6 is very similar in construction to golf club head (31) depicted in FIG. 3; however club head (60) will tend to have a slightly more balanced left-right influence. Referring to FIG. 18, a golf ball struck by club head (60) will tend to have a low trajectory toward point (c,d) of imaginary frame (M) and towards the center of the fairway (182). However, a golf ball struck by club head (31) will tend to move more toward quadrant (D) of imaginary frame (M).

Figure 7:
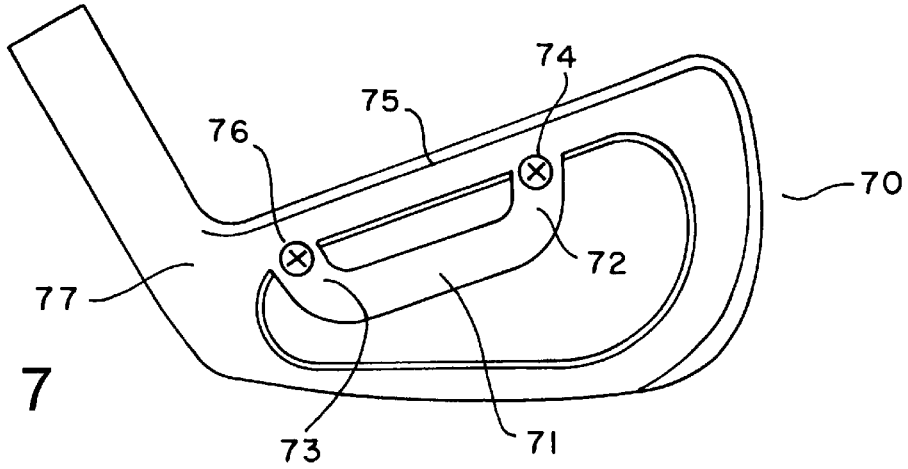
FIG. 7 is a rear elevation of a seventh embodiment of an iron-type golf club head according to the present invention.

As depicted in FIG. 7, club head (70) comprises a bridge member (71) having a first end (73) attached to junction perimeter section (77) and a second end (72) attached to the top-line perimeter section (75). Referring to FIG. 18, club head (70) differs from golf club head (60) in that club head (70) will tend to drive a ball toward the left (L) of the fairway (182) due to the comparatively more central location of point load (74) and the location of point load (76).

Figure 8:
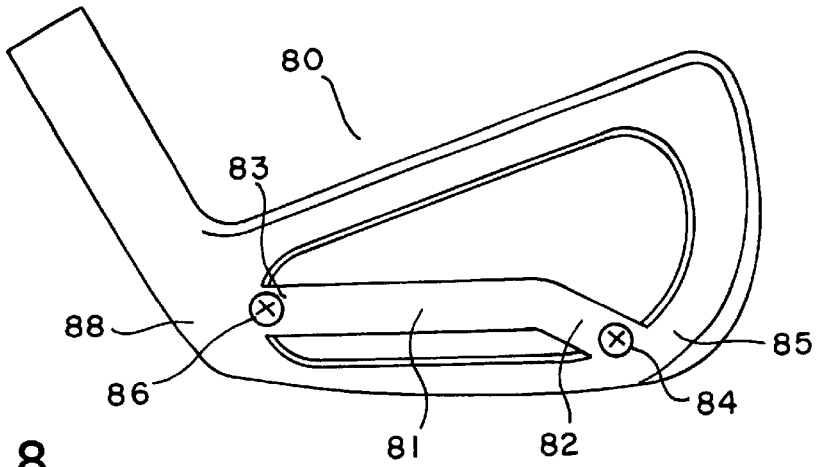
FIG. 8 is a rear elevation of an eighth embodiment of an iron-type golf club head according to the present invention.

Referring now to FIG. 8, club head (80) comprises a bridge member (81) having a first end (83) attached to the heel perimeter section (88) and a second end (82) attached to the junction perimeter section (85). Point load (86) will tend to propel a golf ball toward the left of the fairway while point load (84) will tend to give the ball a high trajectory. Thus, a ball struck by club head (80) will generally have a high initial trajectory and will tend to move toward the left of the fairway.

Figure 9:
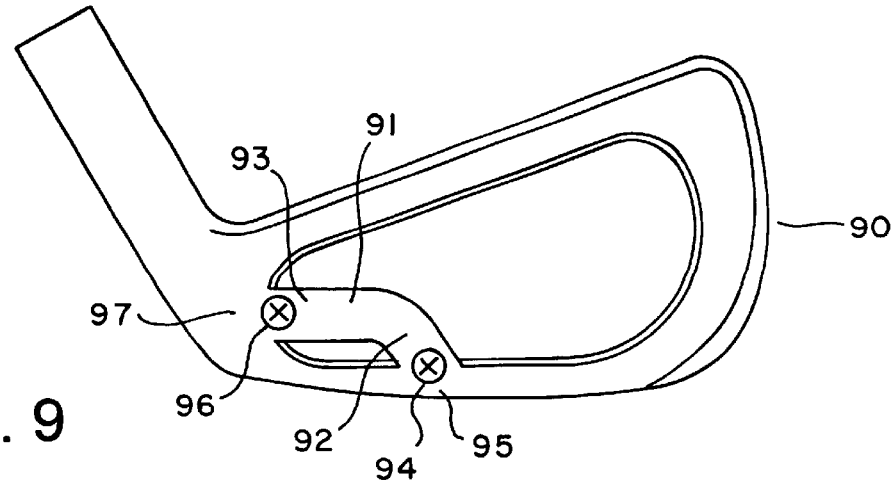
FIG. 9 is a rear elevation of a ninth embodiment of an iron-type golf club head according to the present invention.

Referring now to FIG. 9, club head (90) comprises bridge member (91) having a first end (93) attached to the heel perimeter section (97) forming the point load (96) and a second end (92) attached to the sole perimeter section (95) forming the point load (94). Club heads (80) and (90) differ in their disposition of respective ends (82) and (92). Since the end (92) is more proximal to the heel of club head (90) than the end (82) is to the heel of club head (80), club head (90) will generally propel a ball farther to the left of the fairway than would club head (80).

Figure 10:
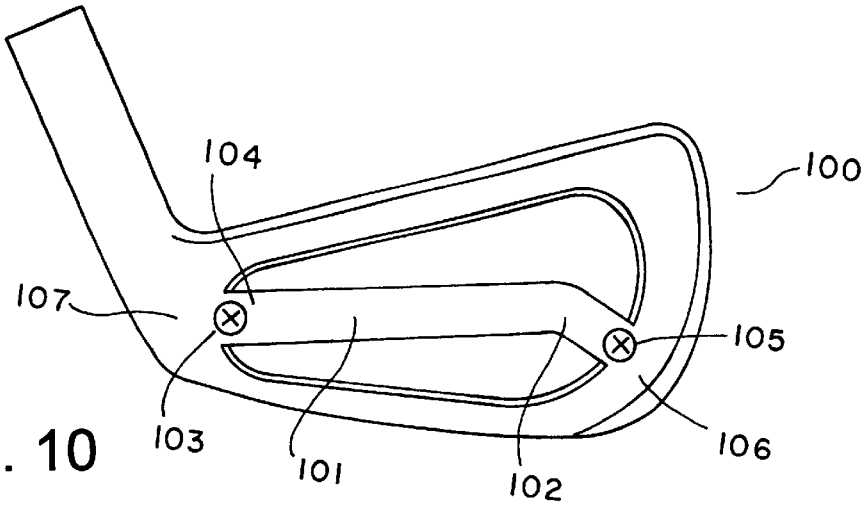
FIG. 10 is a rear elevation of a tenth embodiment of an iron-type golf club head according to the present invention.

FIG. 10 depicts club head (100) comprising a bridge member (101) which has a first end (104) attached to the heel perimeter section (107) thereby forming point load (103) and a second end (102) attached to junction perimeter section (106) thereby forming point load (105). Comparing club heads (100) and (80), second end (102) of club head (100) is more proximal to the toe than is second end (82) of club head (80); therefore, club head (100) will generally propel a golf ball more towards the center of the fairway than would club head (80).

Figure 11:
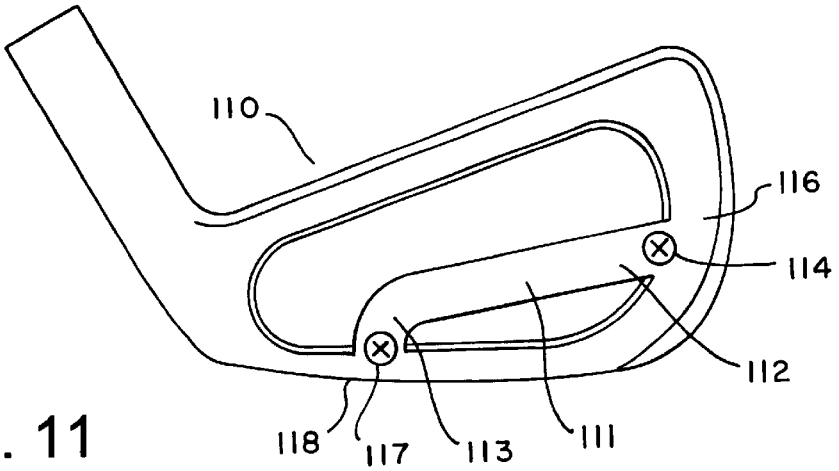
FIG. 11 is a rear elevation of an eleventh embodiment of an iron-type golf club head according to the present invention.

Club head (110) depicted in FIG. 11 comprises a bridge member (111) which has a first end (113) attached to the sole perimeter section (118) thereby forming point load (117) and a second end (112) attached to the toe perimeter section (116) thereby forming point load (114). A golf ball struck by club head (110) will have a generally high initial trajectory due to point load (117) and will tend to veer toward the right of the fairway due to point load (114).

Figure 12:
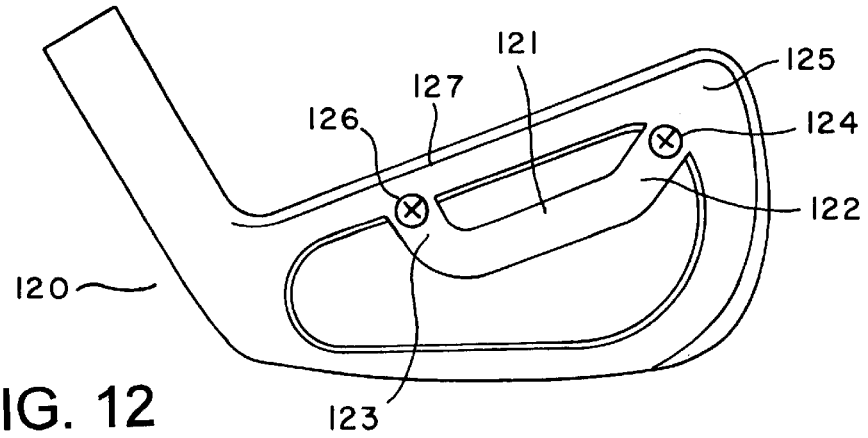
FIG. 12 is a rear elevation of a twelfth embodiment of the iron-type golf club head according to the present invention.

FIG. 12 depicts club head (120) comprising a bridge member (121) having a first end (123) attached to the top-line perimeter section (127) and a second end (122) attached to junction perimeter section (125). Club head (120) is very similar to club head (31) depicted in FIG. 3 except that point load (37) is more proximal to the heel of club head (31) than point load (126) is to the heel of club head (120). Thus, a ball struck by club head (120) will tend to move more toward the right of the fairway than would a ball struck by club head (31). As well, in comparing club head (120) to club head (50) depicted in FIG. 5, a golf ball struck by club head (120) will tend to have a lower trajectory than would a golf ball struck by club head (50).

Figure 13:
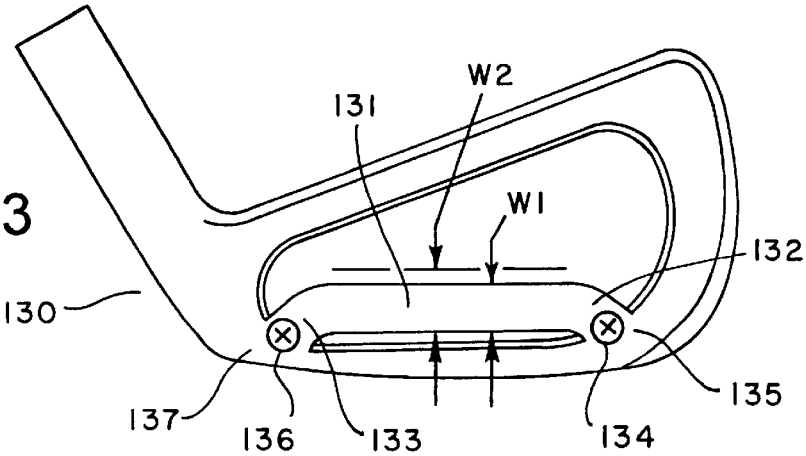
FIG. 13 is a rear elevation of a thirteenth embodiment of an iron-type golf club head according to the present invention.

Depicted in FIG. 13 is club head (130) which comprises a bridge member (131) having a first end (133) attached to junction perimeter section (137) and a second end (132) attached to junction perimeter section (135). A golf ball struck by club head (130) will generally tend to have a very high initial trajectory with no preference toward the left or right of the fairway. Club head (130) when compared to club head (60) depicted in FIG. 6 will tend to have an opposite trajectory. That is, a golf ball struck by club head (60) will generally tend to have a low initial trajectory with no left or right preference.

Figure 14:
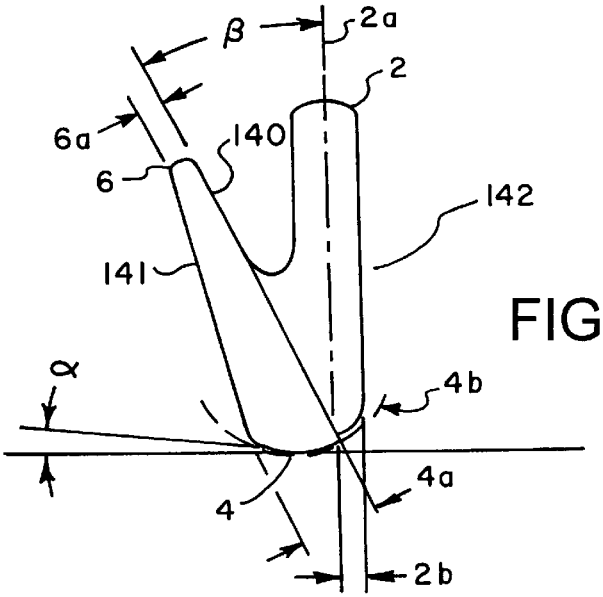
FIG. 14 is a left side elevation view of the first embodiment of an iron-type golf club head according to the present invention as seen from the toe to the heel.

FIG. 14 is an end view of exemplary golf club head (142) wherein the head is viewed from the toe to the heel. As indicated, golf club head (142) has a hosel (2), a golf ball striking surface (140), a back (141), a top-line (6) and a sole (4). The hosel (2) has a bore (not shown) along axis (2*a*). Ball striking surface (140) lies along a plane which is radially spaced from axis (2*a*) of the hosel by an angle β which is referred to as the loft angle of the iron-type club head (142). As shown in FIG. 14, club head (142) has a narrow top-line (6) which width (6*a*) is smaller than the sole (4) which width is (4*a*). Many commercially available clubs have a similar construction as depicted in FIG. 14.

Figure 15:
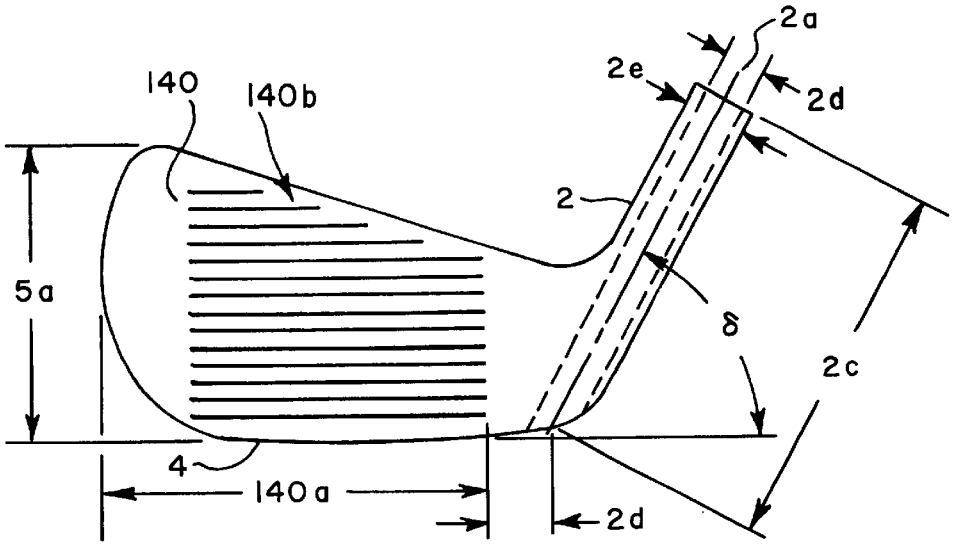
FIG. 15 is a front elevation of the iron-type golf club head shown in FIG. 1.

The golf ball striking surface (140) of club head (142) is depicted in FIG. 15. As shown, golf ball striking surface (140) preferably has score lines (140*b*) which lie parallel to sole (4). The width of the striking surface 140 is depicted as (140*a*) and is measured from the end of the score lines proximal the heel to the toe portion of club head (142). The length (2*c*) of hosel (2) can be varied as desired. As depicted in FIG. 15, length (2*c*) is measured from the distal most end of the hosel down through to the point where axis (2*a*) would penetrate the heel portion of the club head (142). The angle between the axis (2*a*) and a plane along which the sole of the club head lies is called the lie angle and is indicated by δ. As shown, the bore of the hosel has a diameter (2*d*) which is narrower than the width of the hosel (2*e*).

Figure 17:
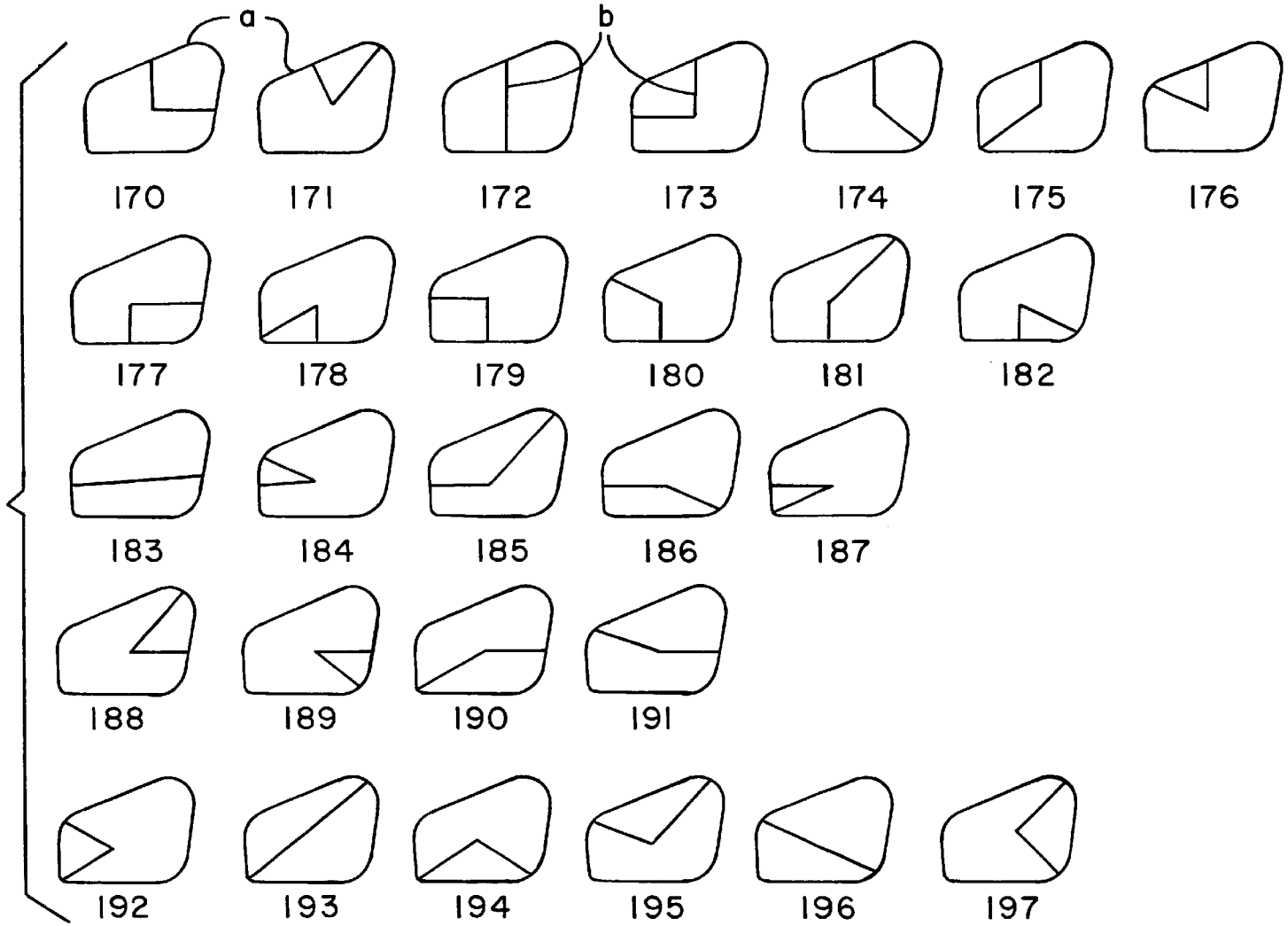
FIG. 17 depicts schematic representations of additional embodiments of the present invention in which the loop structures indicate the peripheral belt of the club head, and the enclosed lines indicate the disposition of the bridge member and its points of attachment.

FIG. 17 depicts twenty-eight exemplary embodiments numbered 170–197 which are contemplated by the present invention. The loop structures indicated by the letter "a" indicate the peripheral belt surrounding the cavity on the back of the club head; whereas, the linear structures indicated by "b" corresponds to the bridge member. Therefore, embodiment (183) corresponds to club head (1) depicted in FIG. 1, embodiment (181) corresponds to club head (41) in FIG. 4, embodiment (179) corresponds to club head (90) depicted in FIG. 9 and embodiment (194) corresponds to club head (130) depicted in FIG. 13.

It should be noted that several bridge member features can be altered to tailor the performance of the club head to the needs of a particular player. These bridge member features include, among other things: 1) its weight; 2) its geometry, particularly with regard to overall width and thickness and to the relative weight of the first end of the bridge member with respect to the second end of the bridge member; 3) its disposition relative to the surface defining the back of the club head; 4) the location of points of attachment (point loads) of the bridge member to the perimeter sections of the peripheral belt of the club head; 5) its center of mass relative to the center of mass of the club head without the bridge member; 6) its moment of inertia; 7) its heel-toe effect; and 8) its top-line-sole effect.

The bridge member can affect the performance of the club head by altering the overall center of gravity (or mass) of the club head. When the weight of the bridge member is increased and the geometry of the bridge member is kept constant, the bridge member's effect upon golf ball trajectory is increased assuming the club head attains the same velocity when it strikes the ball. For example, club head (130) in FIG. 13 comprises bridge member (131) having a particular weight (M1). As previously discussed, this club head will generally tend to propel a golf ball in a trajectory having an initially high loft. If the weight of bridge member (131) is increased to (M2), the trajectory of the ball would have an even higher initial loft.

According to some preferred embodiments, the weight of the bridge member is about 5–20% wt., preferably about 8–20% wt., and more preferably about 15% wt., of the combined weight of the club head and bridge member. In yet other embodiments, the bridge member comprises at least 20%, preferably at least 25% and more preferably at least 40% of the total weight of the club. Generally, the higher the weight of the bridge member relative to the total weight of the club, the greater the effect that the bridge member has upon the trajectory of a ball struck by the club.

The width of the bridge member, at a constant bridge member weight, also influences the trajectory of a golf ball struck by a corresponding club head. Generally, the narrower the width of the bridge member, the more focused the point loads of the golf club head and thus the greater the effect of the bridge member upon golf ball trajectory. For example and referring again to FIG. 13, club head (130) comprises bridge member (131) having a substantially uniform width (W1). If the width (W1) is increased to width (W2, indicated in phantom), the trajectory of a golf ball struck by the club head having the wider bridge member would generally have an initially lower loft than if the ball had been struck by club head (130) having bridge member (131) with width (W1).

The bridge member can have a non-uniform width throughout its length. For example, the first end can be wider than the respective second end. When the first end of the bridge member is wider, and optionally heavier, than the respective second end, the point load corresponding to the first end will have a greater influence upon the trajectory of a golf ball than will the point load corresponding to the second end.

By varying the relative width, or weight, of the middle of the bridge member with respect to the ends of the bridge member, the moment of inertia, the top-line-sole effect and/or the heel-toe effect of the club head can be changed. For example, if the ends of a bridge member extending from heel to toe are wider than the middle of that bridge member, then the moment of inertia of the club head will be wider and the heel-toe effect of the bridge member will be greater than that of a bridge member having narrower ends and a wider center. A club head having a wider moment of inertia will be more "forgiving" for off-center shots than a similar club head having a narrower moment of inertia, i.e., the wider the moment of inertia, the easier it is for a golfer to control the trajectory of a ball.

By heel-toe effect is meant the relative influence that the heel and toe have upon the trajectory of a ball struck by the club. Changes in the relative width or weight of the ends of the bridge member as well as in the positions at which the bridge member ends are attached to the peripheral belt of the club head can be used to alter the heel-toe effect of the club head. The heel-toe effect can be varied to create a club head that preferably drives a ball to the left or right of a fairway. For example, a bridge member having a wider, thicker or heavier, first end attached to the heel portion of the peripheral belt and a narrower, thinner or lighter, respectively, second end attached to the toe portion of the peripheral belt will have a greater heel effect than it does a toe effect, and a ball struck by this club will be driven preferentially to the right of the fairway, and vice versa.

By top-line-sole effect is meant the relative influence that the top-line and sole have upon the trajectory of a ball struck by the club. The top-line-sole effect can be varied to create a club head having an initially higher or initially lower loft. The top-line-sole effect of a club head is altered in a manner similar to that described above for the heel-toe effect except that the bridge member is attached to the top-line and sole portions of the peripheral belt. For example, a bridge member having a wider, thicker or heavier, first end attached to the sole portion of the peripheral belt and a narrower, thinner or lighter, respectively, second end attached to the top-line portion of the peripheral belt will have a greater sole effect than it does a top-line effect, and a ball struck by this club will have an initially higher loft than a club of the opposite construction.

The club head (1) depicted in FIG. 1 comprises the bridge member (20) which has a substantially uniform width throughout its length, i.e. the first end (21) is approximately the same width and weight as the second end (22). As discussed before, this club head has a substantially balanced effect upon ball trajectory, so that a ball struck by this unmodified club head will tend to stay in the center of the fairway. However, if the club head (1) is modified to include the bridge member **(20*a*, indicated in phantom), it will not have a balanced effect upon ball trajectory. That is, since the end (21*a*) is narrower and lighter than the end (22*a*)**, the modified club head will have a greater rightward influence due to the increased weight at the toe of the club head, so that a ball struck by the modified head would tend to move toward the right of the fairway rather than toward the center of the fairway.

Figure 16:
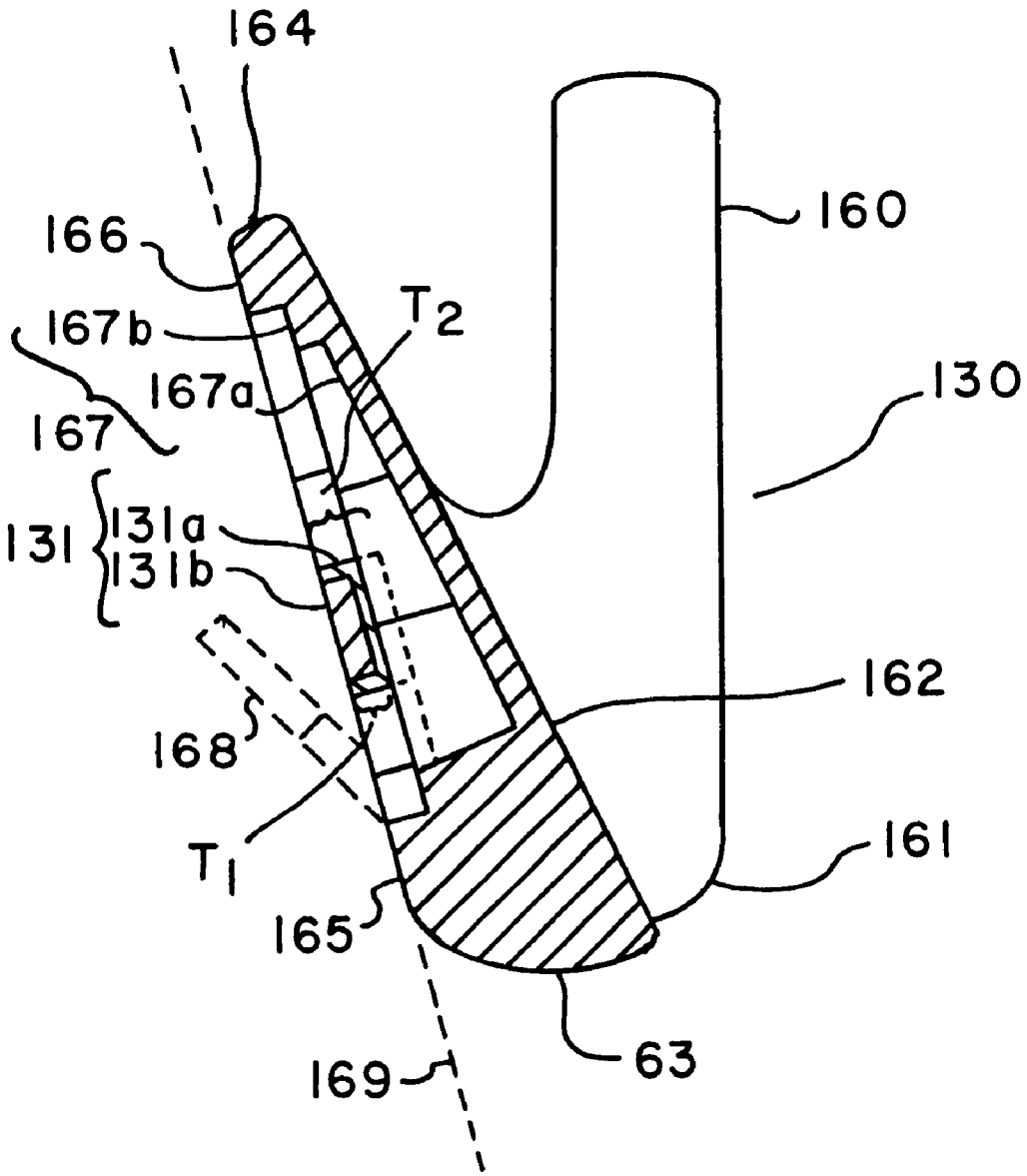
FIG. 16 is a sectional elevation of the iron-type golf club head shown in FIG. 1 as seen from the toe to the heel.

The thickness of the bridge member influences the trajectory of a golf ball struck by a club head as well. Generally, the thicker the bridge member, the more significant the effect of the point loads and thus the greater the effect of the bridge member upon golf ball trajectory. For example, FIG. 16 depicts a cross-sectional view of club head (130) comprising bridge member (131) having thickness (T1). Club head (130) will generally propel a golf ball along a high initial trajectory. If the thickness (T1) is increased to thickness (T2), the trajectory of a golf ball struck by the modified club head would have an even higher initial trajectory.

The disposition of the bridge member relative to the plane defining the back of the club head also affects the performance of the club head. In each of the embodiments depicted in the attached FIGS., the bridge member is superposed a portion of the cavity on the back and disposed along the plane defining the back of the club head. Generally, if the bridge member is not disposed along the plane defining the back of the club head, i.e. the bridge member is more distal to the club head face than is the plane defining the back of the club head, the intended influence of the bridge member upon the trajectory of a golf ball struck by the club head will be increased. FIG. 16 depicts a cross-sectional view of exemplary club head (130) comprising bridge member (131) which is superposed a portion of cavity (167) and disposed along the plane (169) defining back (165) of club head (130). If bridge member (167) is spaced from plane (169) to the exemplary location indicated by bridge member (165, depicted in phantom), the modified club head would propel a golf ball along an even higher initial trajectory, i.e. higher loft, than would be achieved with the unmodified club head.

Accordingly, the larger the distance between the most distal portion of the bridge member and the back surface of the club, the greater the effect that the bridge member will have upon the trajectory of a ball struck by the club. In some embodiments, the most distal portion of the bridge member will be spaced from the back of the striking surface by about 1/16 to 2 inches, preferably about 1/8 to 3/4", and more preferably about 1/8 to 1/2".

In view of the above discussion, it should be evident that several obvious embodiments of the bridge member, each having a different configuration, can easily be made. For example, the bridge member can be formed from extruded shapes such as a square, rectangle, circle, oval, triangle, trapezoid or any other geometric, regular, irregular, symmetrical or asymmetrical shape.

Configurations in which the bridge member weight are modified are contemplated by the present invention, since bridge member weight plays a great role in the degree of influence that the bridge member has upon the trajectory of a ball struck by the golf club. For example, and with reference to FIG. 16, bridge member (131) can comprise two different metals **(131*a*) and (131*b*) which may possess either the same or different densities. In a particular embodiment of the invention, the first metal (131*a*) substantially surrounds a portion of the second metal (131*b*) and the second metal (131*b*) is substantially coextensive with a major portion of the metal (131*a*)**.

It will be understood by those of ordinary skill in the art that the materials of construction for the iron-type golf club head of the present invention can comprise any known materials typically used for this purpose. For example, various metals, stainless steel, titanium alloys, aluminum alloys, aluminum bronze alloys, amorphous ceramic metal alloys, carbon graphite materials, tungsten, polymers and combinations thereof.

Figure 19:
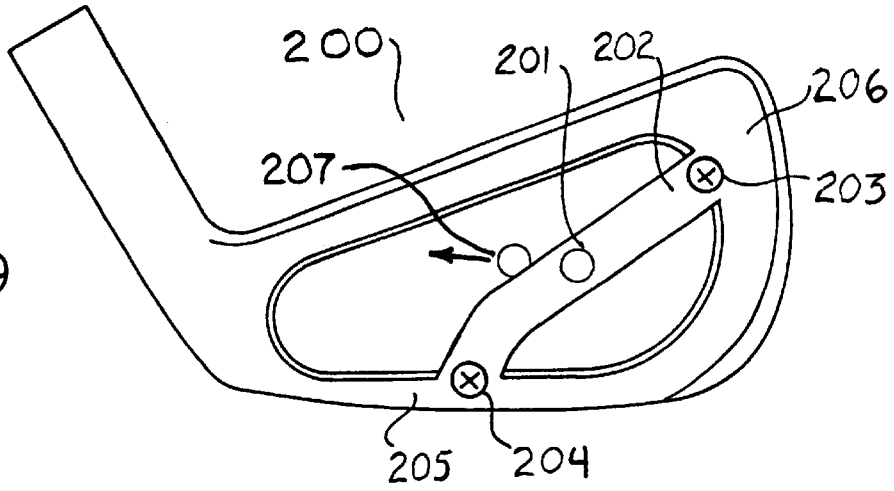
FIG. 19 is a rear elevation view of the club head of FIG. 4.

The geometry, weight, configuration, and relative disposition of the bridge member affect its center of mass relative to the center of mass of the club head not having the bridge member. For example with reference to FIG. 19, the center of mass (201) of the bridge member (202) is disposed spaced away from and is more toward the toe (206) and sole (205) of the club head (200) than is the center of mass (207) of the club head. Therefore, a ball struck by this club head will have a trajectory directed toward the heel of the club head (200), i.e., its trajectory will be more towards the left of the fairway in the direction of the arrow and will have a slightly higher initial loft than would a ball struck by a similar club head not having the bridge member (202).

Figure 20:
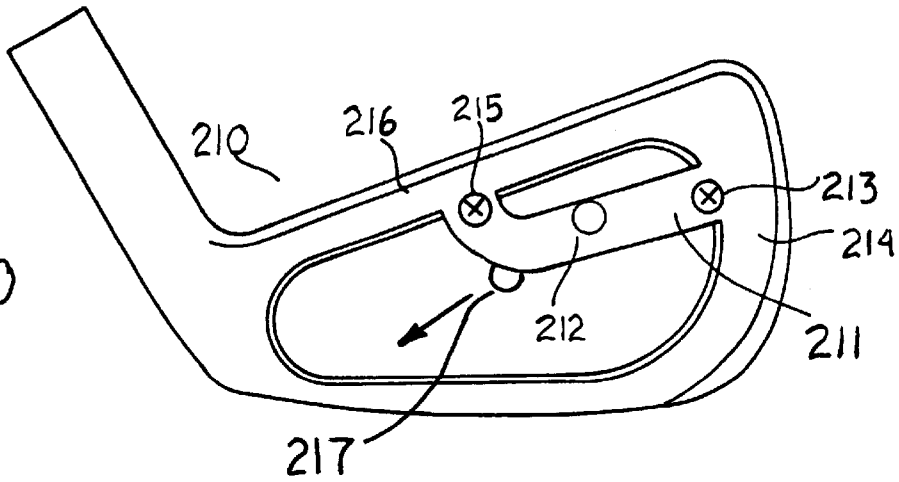
FIG. 20 is a rear elevation view of the club head of FIG. 5.

On the other hand, the club head (210) depicted in FIG. 20 will provide a different preferred trajectory. The center of mass (212) of the bridge member (211) is disposed more toward the top-line (216) and toe (214) of the club head (210) than is the center of mass (217) of the club head. Therefore, a ball struck by the club head (210) will have a trajectory directed toward the sole and heel of the club head, i.e., its trajectory will have a lower initial loft and will be directed more towards the left of the fairway in the direction of the arrow than would a ball struck by a similar club head not having the bridge member (211).

The effect of the bridge member's center of mass upon the trajectory of a ball struck by a club head having the bridge member is generally summarized as follows: the more the center of mass of the bridge member is disposes toward a first portion of the peripheral belt, the more a ball struck by the club head will be driven along a trajectory away from the center of mass of the bridge member toward the opposite side of the center of mass of the club head.

The inventive features of the golf club head of the present invention can be incorporated into many commercially available iron-type golf club heads having a large main cavity on the back. Club head (130) depicted in FIG. 16 comprises a stepped cavity (167) having a first shallow portion (167*b*) which delimits a second deeper portion section (167*a*). Thus, as depicted, section (167*b*) is a peripheral portion with a shallow depth extending toward face (162) and section (167*a*) is a central portion with progressively increasing depth extending towards face (162). Portion (167*b*) of the cavity is delimited by central portion (167*a*) of the cavity. In a particular embodiment of club head (130) depicted in FIG. 16, peripheral portion (167*b*) of the cavity has a substantially constant depth.

As previously discussed, conventional iron-type golf a club heads having a large cavity on the back can be modified to include the inventive bridge member described herein. Thus, another aspect of the invention provides a method of preparing an iron-type golf club head having a bridge member capable of influencing the trajectory of a ball struck by the club head. In a particular embodiment, the invention is a method of preparing an iron-type golf club head comprising the steps of:

providing an iron-type, solid body golf club head comprising a substantially planar face having a golf ball-striking surface with a center portion, a back opposite the face having a single large cavity extending toward the face, a peripheral belt having respective perimeter portions connecting the face and the back and surrounding the cavity;

providing a single bridge member having first and second ends; and attaching each of the first and second ends to a perimeter portion of the peripheral belt such that the bridge member superposes a portion of the cavity and is spaced from the back.

It should be noted that all of the club heads depicted in the attached figures are configured for use with a right-handed golf swing; however, it is contemplated by the present invention that the clubs could be configured for use with a left-handed golf swing as well. Such left-handed configured clubs will generally have a construction that mirrors the construction of the club heads depicted in the attached drawings.

Thus, the bridge member of the present club head can be modified and optimized as described herein to easily provide club heads tailored to the particular needs of any given player.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

What is claimed is:

1. An iron-type golf club head having a solid metal body comprising:

a face defined by a substantially flat first plane and including a golf-ball-striking surface with a center portion, said face having an opposing rear surface;

a heel having an upwardly extending hosel for receiving one end of an elongated shaft;

a toe opposite and taller in height than the heel, the face being interposed the toe and the heel;

a sole interposed the heel and the toe and disposed below the face;

a top-line interposed the heel and the toe and superposed the sole and the face;

a back defined by a second plane which is inclined relative to the first plane defining the face, the back being opposite the face and having a single open cavity extending toward the face and covering a majority of the back, the cavity having a first larger portion adjacent the toe and a second smaller portion adjacent the heel;

a peripheral belt surrounding the cavity of the back and including a toe perimeter portion, a heel perimeter portion, a sole perimeter portion, a top-line perimeter portion and junction perimeter portions interposed adjacent ones of the toe, heel, sole and top-line perimeter portions, wherein a majority of the weight of the club head is disposed within the peripheral belt; and a single bridge member superposed a portion of the cavity, spaced away from said rear surface of said face, the bridge member comprising a first end and a second end attached to the belt in combinations, respectively, selected from a group consisting of the top-line perimeter portion and the toe perimeter portion, the top-line perimeter portion and the heel perimeter portion, the top-line perimeter portion and a junction perimeter portion, the sole perimeter portion and the heel perimeter portion, the sole perimeter portion and a junction perimeter portion, the heel perimeter portion and a junction perimeter portion, the toe perimeter portion and a junction perimeter portion, and a first junction perimeter portion and a second junction perimeter portion so as to place the center of mass of the bridge member in a predetermined location different from the location of the center of mass of the club head absent the bridge member;

whereby the trajectory of a ball struck by the center of the golf ball-striking surface of the face is influenced by the location of the center of mass of the bridge member relative to the center of mass of the club head absent the bridge member.

2. An iron-type golf club head as defined in claim 1, wherein the bridge member comprises a first metal and a second metal.

3. An iron-type golf club head as defined in claim 2, wherein the density of the first metal is lower than the density of the second metal.

4. An iron-type golf club head as defined in claim 2, wherein the first metal is disposed adjacent the first end of the bridge member and the second metal is disposed adjacent the second end of the bridge member.

5. An iron-type golf club head as defined in claim 2, wherein at least a portion of the second metal is surrounded by the first metal.

6. An iron-type golf club head as defined in claim 2, wherein the first metal and the second metal are substantially coextensive.

7. An iron-type golf club head as defined in claim 1, wherein the weight of the bridge member is at least about 5% of the total weight of the club head.

8. An iron-type golf club head as defined in claim 7, wherein the weight of the bridge member is about 5–20% of the total weight of the club head.

9. An iron-type golf club head as defined in claim 7, wherein the weight of the bridge member is about 8–20% of the total weight of the club head.

10. An iron-type golf club head as defined in claim 7, wherein the weight of the bridge member is about 15% of the total weight of the club head.

11. An iron-type golf club head as defined in claim 7, wherein the weight of the bridge member is at least about 25% of the total weight of the club head.

12. An iron-type golf club head as defined in claim 7, wherein the weight of the bridge member is at least about 40% of the total weight of the club head.

13. An iron-type golf club head as defined in claim 1, wherein the center of mass of the bridge member is closer to a portion of the peripheral belt than is the center of mass of the club head absent the bridge member.

14. An iron-type golf club head as defined in claim 1, wherein the center of mass of the bridge member is closer to the toe of the club head than is the center of mass of the club head absent the bridge member.

15. An iron-type golf club head as defined in claim 1, wherein the center of mass of the bridge member is closer to the heel of the club head than is the center of mass of the club head absent the bridge member.

16. An iron-type golf club head as defined in claim 1, wherein the center of mass of the bridge member is closer to the top-line of the club head than is the center of mass of the club head absent the bridge member.

17. An iron-type golf club head as defined in claim 1, wherein the center of mass of the bridge member is closer to the sole of the club head than is the center of mass of the club head absent the bridge member.

18. An iron-type golf club head as defined in claim 1, wherein the bridge member is spaced from the rear surface of the face.

19. An iron-type golf club head as defined in claim 18, wherein the bridge member is spaced from the rear surface of the face by about 1/16 to 2 inches.

20. An iron-type golf club head as defined in claim 1, wherein the weight of the bridge member is at least about 5% of the total weight of the club head.

21. A method of preparing an iron-type golf club head comprising the steps of:

providing an iron-type, solid body golf club head comprising a substantially planar face having a golf ball-striking surface with a center portion, a back opposite the face having a single large cavity extending toward the face, a peripheral belt having respective perimeter portions connecting the face and the back and surrounding the cavity;

providing a single bridge member having first and second ends; and attaching the first and second ends of the bridge member to a perimeter portion of the peripheral belt in combinations, respectively, selected from a group consisting of the top-line perimeter portion and the toe perimeter portion, the top-line perimeter portion and the heel perimeter portion, the top-line perimeter portion and a junction perimeter portion, the sole perimeter portion and the heel perimeter portion, the sole perimeter portion and a junction perimeter portion, the heel perimeter portion and a junction perimeter portion, the toe perimeter portion and a junction perimeter portion, and a first junction perimeter portion and a second junction perimeter portion so as to place the center of mass of the bridge member in a predetermined location different from the location of the center of mass of the club head absent the bridge member such that the bridge member superposes a portion of the cavity, is spaced from the back opposite the face, and the position of the bridge member relative to the center of mass of the club head influences the trajectory of a ball struck by the club head.

22. A system for influencing the trajectory of a golf ball struck by an iron-type golf club head comprising:

an iron-type, solid body golf club head comprising a substantially planar face having a golf ball-striking surface with a center portion, a back opposite the face having a single large cavity extending toward the face, a peripheral belt having respective perimeter portions connecting the face and the back and surrounding the cavity; and a single bridge member superposing a portion of the cavity and spaced from the back opposite the face, the bridge member comprising first and second ends each attached to a perimeter portion of the peripheral belt in combinations, respectively, selected from a group consisting of the top-line perimeter portion and the toe perimeter portion, the top-line perimeter portion and the heel perimeter portion, the top-line perimeter portion and a junction perimeter portion, the sole perimeter portion and the heel perimeter portion, the sole perimeter portion and a junction perimeter portion, the heel perimeter portion and a junction perimeter portion, the toe perimeter portion and a junction perimeter portion, and a first junction perimeter portion and a second junction perimeter portion so as to place the center of mass of the bridge member in a predetermined location different from the location of the center of mass of the club head absent the bridge member;

wherein the trajectory of a ball struck by the golf ball striking surface is influenced by position of the bridge member relative to the center of mass of the club head.

23. An iron-type golf club head comprising:

a peripheral belt surrounding a cavity defined by a rear surface in the back of the club head; and a single bridge member superposing and spaced away from the rear surface, the bridge member having two ends, each attached to the peripheral belt in combinations, respectively, selected from a group consisting of the top-line perimeter portion and the toe perimeter portion, the top-line perimeter portion and the heel perimeter portion, the top-line perimeter portion and a junction perimeter portion, the sole perimeter portion and the heel perimeter portion, the sole perimeter portion and a junction perimeter portion, the heel perimeter portion and a junction perimeter portion, the toe perimeter portion and a junction perimeter portion, and a first junction perimeter portion and a second junction perimeter portion so as to place the center of mass of the bridge member in a predetermined location different from the location of the center of mass of the club head absent the bridge member;

wherein the disposition of the moment of inertia of the club head is modified to thereby influence the trajectory of a ball struck by the club head.

* * * * *

UNITED STATES PATENT AND TRADEMARK OFFICE

CERTIFICATE OF CORRECTION

PATENT NO. : 6,280,348 B1 
DATED : August 28, 2001
INVENTOR(S) : John T. Stites and Michael G. Taylor It is certified that error appears in the above-identified patent and that said Letters Patent is hereby corrected as shown below:

Title page,
Item [75], Inventor: add -- Michael G. Taylor, Granbury, TX (US) -- as a coinventor Signed and Sealed this Thirty-first Day of December, 2002

JAMES E. ROGAN
*Director of the United States Patent and Trademark Office*